US005415486A

United States Patent [19]

Wouters et al.

[11] Patent Number: 5,415,486

[45] Date of Patent: May 16, 1995

[54] DYE RIBBON PACKAGE FOR USE WITH A THERMAL PRINTER AND A METHOD OF LOADING THE RELOADABLE CASSETTE OF A THERMAL PRINTER WITH A DYE RIBBON FROM A DYE RIBBON PACKAGE

[75] Inventors: Paul Wouters, O.L.Vrouw Waver; Lieven Dirx, Oud-Turnhout, both of Belgium

[73] Assignee: Agfa-Gevaert N. V., Mortsel, Belgium

[21] Appl. No.: 136,267

[22] Filed: Oct. 15, 1993

[30] Foreign Application Priority Data

Oct. 22, 1992 [EP] European Pat. Off. ..... 92203247

[51] Int. Cl.[6] ..... B41J 29/02; B65H 75/00

[52] U.S. Cl. ..... 400/692; 400/693.1; 400/207; 400/242; 400/246; 206/393; 206/394

[58] Field of Search ..... 400/207, 693.1, 208, 400/250, 242, 243, 244, 245, 246, 692; 206/391, 393, 394, 395, 396, 397, 407, 415; 229/123, 178; 242/55.2, 55.3, 55.53, 399

[56] References Cited

U.S. PATENT DOCUMENTS

| | | | |
|---|---|---|---|
| 3,332,546 | 7/1967 | DeGeorge | 206/395 |
| 3,520,409 | 7/1970 | Gibbs, Sr. | 242/55.53 |
| 3,530,980 | 9/1970 | Link | 206/394 |
| 4,151,914 | 5/1979 | Blatt | 206/395 X |
| 5,174,667 | 12/1992 | Sugimoto et al. | 400/207 |

FOREIGN PATENT DOCUMENTS

| | | | |
|---|---|---|---|
| 0213180 | 2/1987 | Japan | 101/246 |
| 0213181 | 2/1987 | Japan | 101/246 |
| 0283971 | 11/1988 | Japan | 400/246 |
| 0286876 | 11/1989 | Japan | 400/246 |
| 0027664 | of 1905 | United Kingdom | 206/391 |

*Primary Examiner*—Edgar S. Burr
*Assistant Examiner*—Christopher A. Bennett
*Attorney, Agent, or Firm*—William J. Daniel

[57] ABSTRACT

A dye ribbon package for use with a thermal printer and containing for that purpose in spaced parallel relation therein a supply spool wound with dye ribbon and a take up spool for rewinding the dye ribbon as it is unwound from the supply package, a leading end of the dye ribbon on the supply spool being attached to the take up spool, each spool having a winding core with a free end portion, in which the package has a bottom wall and at each of the opposite sides of the bottom wall normal to the spool axes upstanding lateral wall integral with the bottom wall. Each lateral wall has two laterally spaced apart panels, both cut out downwardly from their edges opposite the bottom wall to removably receive the free end portions of the spool cores and permit free access to the end faces of the spool cores. The opposite sides of the bottom wall are spaced apart a distance greater than the length of the spool cores so that the upstanding outer penel wall at least partially shields the core end faces without preventing axial access thereto through the cut out in the outer wall panel. In cross-section, the lateral walls can be of inverted U-shape and inwardly sloping inverted V-shape.

16 Claims, 6 Drawing Sheets

DYE RIBBON PACKAGE FOR USE WITH A THERMAL PRINTER AND A METHOD OF LOADING THE RELOADABLE CASSETTE OF A THERMAL PRINTER WITH A DYE RIBBON FROM A DYE RIBBON PACKAGE

BACKGROUND OF THE INVENTION

1. Field of the invention

The present invention relates to a dye ribbon package for use with a thermal printer which comprises a supply spool with a roll of dye ribbon wound thereon and a take-up spool having the leading end of the dye ribbon attached thereto, and to a method of loading the reloadable cassette of a thermal printer with the dye ribbon from the described package.

2. Description of the prior art

In a typical color thermal printer, a dye ribbon in the form of a web-type dye-carrier containing a series of spaced frames of different coloured heat transferable dyes is spooled on a supply spool. The ribbon is unwound from the supply spool and rewound on a take-up spool. The ribbon moves through a nip formed between a thermal print head and a dye-absorbing receiver sheet. The receiver sheet may, for example, be coated on synthetic paper and the print head is formed of a plurality of heating elements. When heat is supplied to the dye ribbon, dye is transferred to the receiver sheet.

At the beginning of a print cycle, the receiver sheet must .be clamped to the drum of the printer which is at a home or starting position. After being clamped to the drum, the receiver sheet is advanced under the print head. The heating elements of the print head are energised to form a dye image. The drum makes several revolutions as different coloured dye images are applied into the receiver sheet. In this way, a final, full-coloured image is produced. Thereupon, the clamp of the drum is opened and the receiver sheet is ejected from the thermal printer. The drum then advances the clamping mechanism back to the home position and the above-mentioned process is repeated.

The dye ribbon is difficult to handle since it has typically a thickness in the order of magnitude of ten micrometers only, in order not to impede the heat transfer from the heating elements towards the receiver sheet. For that reason, the supply spool and the take up spool are usually provided in a dedicated cassette which has a central rectangular opening for allowing the print head to urge the ribbon in contact with the receiver.

Known cassettes are made from plastic and are of the disposable type so that convenience for the operator of the printer is high. Since environmental considerations are placing an ever increasing strain on the use of disposable cassettes, there is a recent trend to use reloadable cassettes. These reloadable cassettes have basically the same configuration as the original dedicated ones but have a two part construction allowing the operator to open them and to load them with a supply spool with a roll of fresh dye ribbon and an empty take up spool. The loaded cassette is then put in the printer in the same way as an original disposable cassette.

The difficulty with the described reloading procedure resides in the manipulations that are required to remove the supply spool and the take up spool from the package in which they are wrapped by their manufacturer in order to load them in an empty cassette. In a known packaging form, the supply spool and the take-up spool are wrapped closely together in a bubble foil that is kept closed by self-adhesive tape, which package is wrapped in a rigid rectangular cardboard box.

Removal of the bubble foil and gripping of the spools to insert them in the cassette inevitably brings the operator's hands in contact with the thin dye ribbon which is extremely vulnerable and can be damaged by wrinkling and even by mere skin contact.

A thermal printer and a dye ribbon cassette for use therein are disclosed e.g. in U.S. Pat. No. 4,815,870 and 4,915,516.

SUMMARY OF THE INVENTION

Objects of the Invention

It is an object of the present invention to provide a dye ribbon package which comprises a supply spool with a roll of dye ribbon wound thereon and a take-up spool for rewinding the ribbon which is intended for reloading a reloadable cassette of a thermal printer, and which provide a good balance between ecological aspects and convenience of use for the operator.

It is a further object of the invention to provide an improved method for loading a reloadable cassette of a thermal printer with a supply spool having a roll of dye-ribbon wound thereon and with a take-up spool having the leading end of the dye ribbon attached thereto.

Statement of the Invention

In accordance with the present invention, a dye ribbon package for use with a thermal printer which comprises a supply spool with a roll of dye ribbon wound thereon and a take-up spool having the leading end of the dye ribbon attached thereto for rewinding the ribbon as it is unwound from the supply spool, is characterized by a bottom wall and two upstanding opposed lateral wall means having opposed slotlike openings for engagement with the corresponding ends of the cores of the spools thereby to support both spools in parallel relationship, said slotlike openings allowing easy removal of the spools from the package in a direction radial to their axis, and the slotlike openings being open at their lateral outside surface thereby allowing gripping of the front ends of the spools by an operator's fingers.

The inventive package forms so to say a loading aid for transferring the spools with the ribbon from their initial package wrapping into the cassette of a printer. A direct transfer of the ribbon and the spools into a printer is theoretically feasable but practically uninteresting since locating the ribbon and spools in a cassette allows easy removal of them from the printer in the event of ribbon or receiver sheet jam or any other defect requiring removal of the ribbon from the printer, or for replacing a colour ribbon by a black and white ribbon.

The package preferably has a cover comprising one or more hinged panels that can enclose the wrapped spools in its closed position so that a closed box can be obtained forming a rigid holder for storage and transport of the spools.

The package can be made from any suitable material that readily lends itself to an economical and ecologically disposable wrapper, e.g. corrugated board, either paper or plastic such as polypropylene board, which has been cut into the correct blank size and creased to produce a folding carton that constitutes the wrapping box.

According to a suitable embodiment of the invention, each side wall means of the package comprises two wall panels arranged in spaced parallel, upstanding relation on a bottom wall the inside wall panels co-operating with flanges on the spools to control the axial position of the spools in the package and the outside wall panels lying in a plane outside the end faces of the spools thereby to protect such end faces from accidental contact during transport and the like.

According to a further suitable embodiment of the invention, each of the side wall means of the package panels comprises two wall sections, namely an inside wall panel co-operating with flanges on the spools as described hereinbefore, and inclined outside wall panels running obliquely outwardly from the top of the inside sections towards the bottom of the package. This configuration has the advantage of an improved stiffness in a transverse plane, and of an improved accessibility to end faces of the spools.

According to a still further suitable embodiment of the invention, each spool has two flanges and at least one flange has a diameter at least equal to that of a roll of wound ribbon thereby to allow easy rotation of the spool by an operator while avoiding contact with the roll of ribbon.

The present invention encompasses also a method for reloading a thermal printer.

In accordance with this aspect of the invention, a method of loading a reloadable cassette of a thermal printer with a supply spool having a roll of dye ribbon wound thereon and with a take up spool having the leading end of the dye ribbon attached thereto, comprises the steps of placing the reloadable cassette on a desk or other flat surface, locating a dye ribbon package in accordance with the invention on said surface in front of said cassette, removing from the package the spool which is nearest to the cassette and loading said spool in the cassette at the spool position which is nearest to the dye ribbon package, and next removing from the package the spool which is remote from the cassette and loading said spool in the cassette at the spool position which is most remote from the dye ribbon package.

In an alternative technique, loading of reloadable cassette of a thermal printer with a supply spool having a roll of dye ribbon wound thereon and with a take up spool having the leading end of the dye ribbon attached thereto, comprises the steps of placing the reloadable cassette on a desk or other flat surface, locating a dye ribbon package in accordance with the invention on said surface in front of the cassette, removing from the cassette the spool which is remote from the cassette and loading said spool in the cassette at the spool position which is remote from the dye ribbon package, and next removing from the package the spool which is nearest to the cassette and loading said spool in the cassette at the spool position which is nearest to dye ribbon package.

According to a final aspect of the invention, a reloadable cassette for a thermal printer for use in the method disclosed hereinbefore, comprises two flanges, a plurality of parallel rods interconnecting the flanges in parallelly spaced relationship thereby to constitute a frame, and elastic clip means open on the top side of the flanges for engaging the core ends of the spools, the entry end of said clip means having an opening width smaller than the diameter of said core ends, and the central area of said clip means having a width larger than the diameter of said core ends.

BRIEF DESCRIPTION OF THE DRAWINGS

The invention will be described hereinafter by way of example with reference to the accompanying drawings wherein.

DETAILED DESCRIPTION OF THE INVENTION

Figure 1:
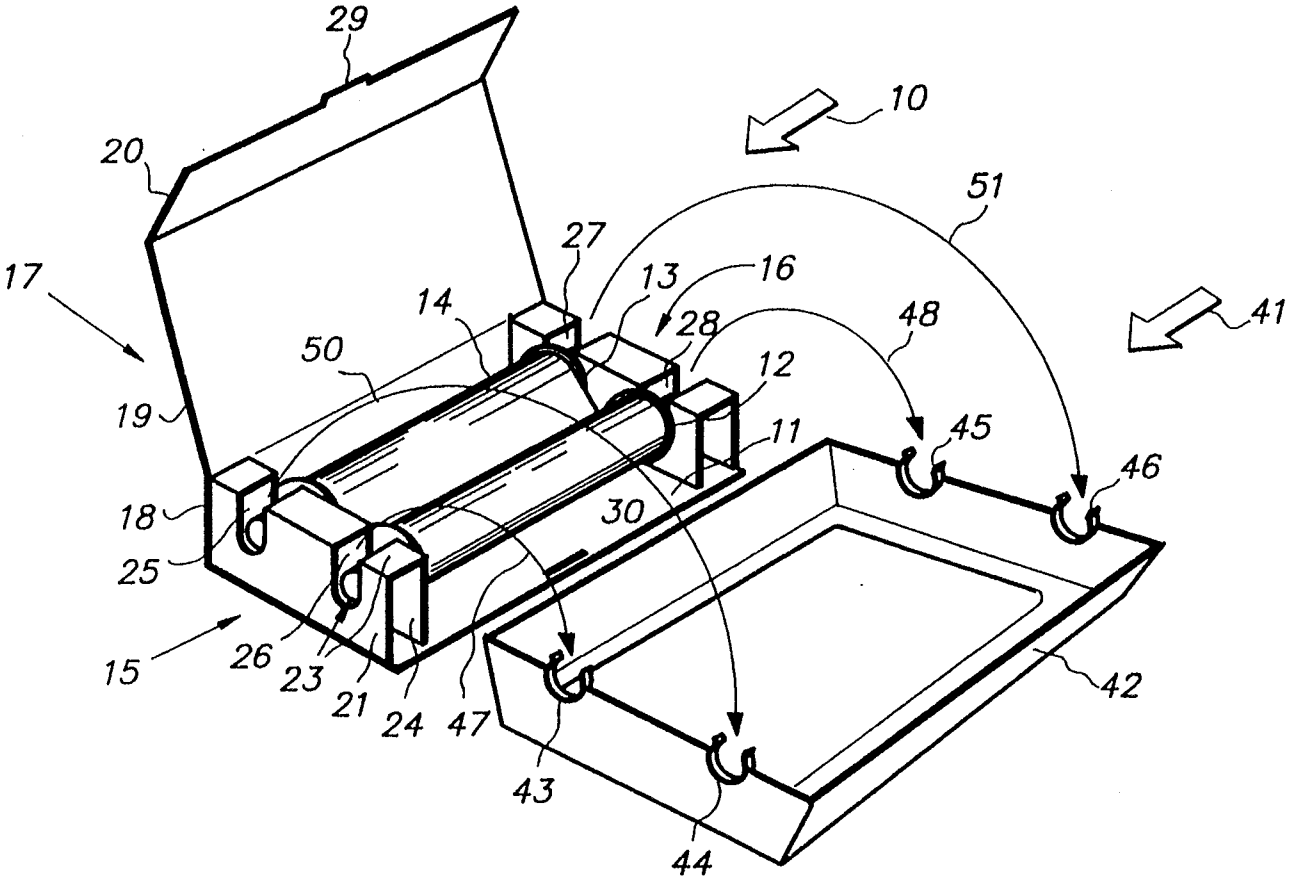
FIG. 1 is a perspective view of one embodiment of a package according to the invention, and of a cassette suitable for being reloaded with spools packaged in said package.

Referring to the perspective view of FIG. 1, a package 10 in accordance with the invention comprises a supply spool 12 with a roll of dye ribbon 13 wound thereon and a take-up spool 14 to which the leading end of the dye ribbon is attached for rewinding the ribbon as it is paid of from the supply spool.

The package 10 is formed from a sheet of corrugated paper board which has been appropriately cut and creased to allow it to be folded for obtaining a construction as shown in the figure. The package comprises a base portion with a bottom wall 11 and two opposed upstanding lateral walls 15 and 16, and a cover 17 comprising three panels 18, 19 and 20-which are hingedly connected together, panel 18 being hingedly connected to bottom wall 11.

Walls 15 and 16 are formed by wall sections folded in the form of an inverted U, as shown by wall sections 21, 23 and 24 for wall 15, sections 21 and 24 running parallel with each other. Each of the walls 15 and 16 has two vertical slotlike openings, that is 25, 26 and 27, 28, that are formed by cut-away portions of the paper board.

Wall section 21 is folded upwardly from bottom wall 11, whereas wall section 24 has a small lip or tab that engages a corresponding slot in the bottom panel for fixing the position of the wall section. This lip-and-slot connection is not visible in the figure, but a similar construction is shown for lid 17, panel 20 of which has a lip or tab 29 for engagement with a slot 30 in bottom wall 11.

Figure 2:
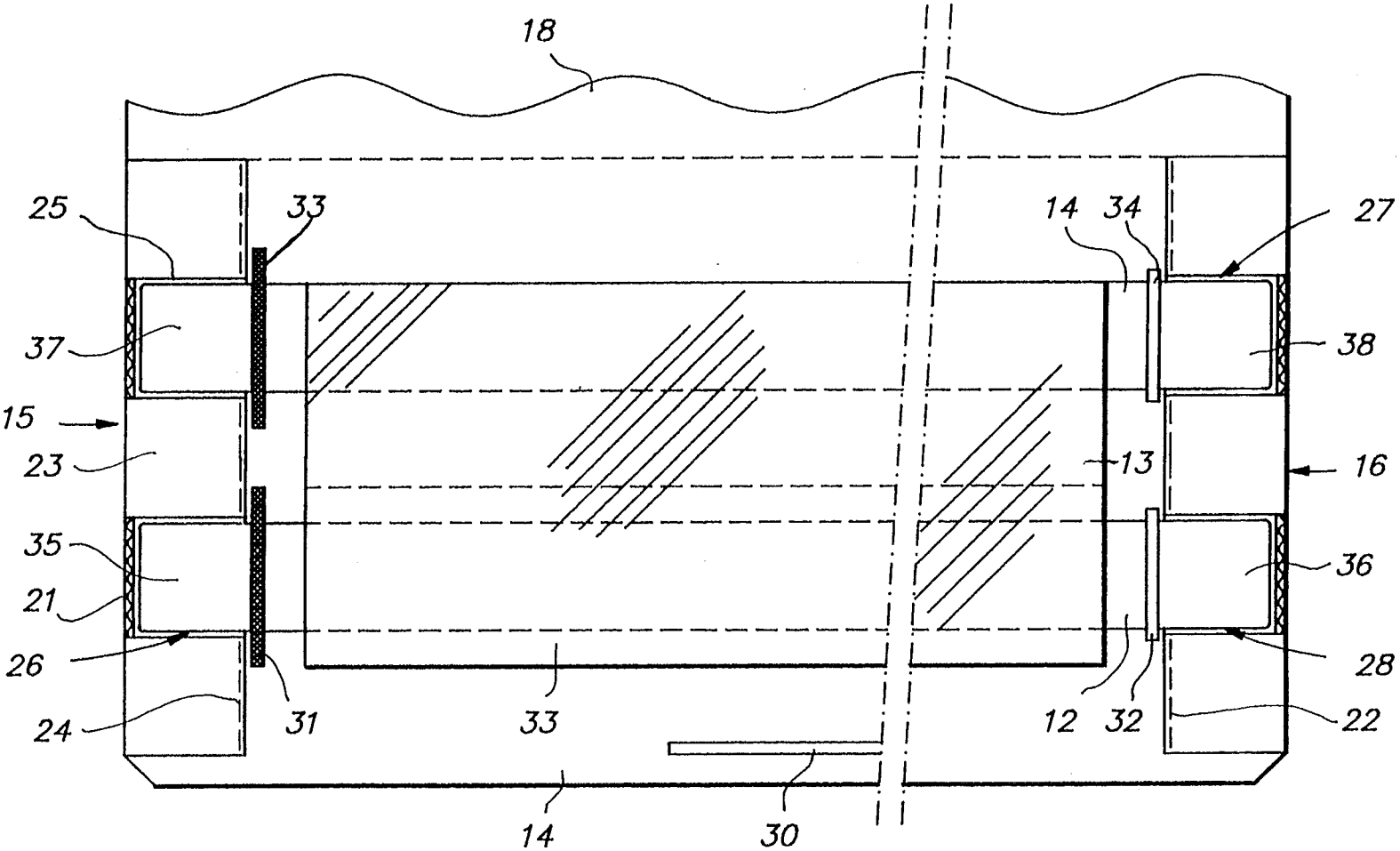
FIG. 2 is a top view of the package according to FIG. 1.

FIG. 2 shows a top view of the opened package according to. FIG. 1, cover 18 being partly cut away. The unwinding spool 12 with the roll 33 of ribbon 13 and the take up spool 14 each have a winding core carrying axially spaced aport have flanges 31, 32 and 33, 34 that determine the axial position of the spools in the package by abutment against the inside walls of the lateral wall means, such as wall panels 22 and 24. One or both flanges of each spool preferably has a diameter at least equal to that of the roll 33 of unwound ribbon for engagement by the operator's fingers to occasionally rotate a spool for tensioning a slack ribbon. Such larger flanges can have a knurled rim for improved frictional engagement, as shown for flanges 31 and 33. The width of the ribbon is smaller than the distance separating both flanges of each spool 10, so that frictional contact with the lateral edges of the ribbon is avoided.

The core ends 35, 36, 37 and 38 of the spools fit in the corresponding slotlike openings of lateral walls 15 and 17 with a slight clearance, and their length is such that i f a spool flange abuts a lateral wall, the corresponding end face of the spool still does not protrude beyond the package.

The ends of the spools may be appropriately shaped for being engaged by driving and journalling spindles of a thermal printer. In a known way, the core ends may have opposed slots such as 39 shown in FIG. 4, for engagement by radial pins of a driving spindle. Alternatively, the core ends may have a square or otherwise shaped central opening for engagement with a driving spindle, or the front ends may have a toothed rim for engagement by a correspondingly toothed collar on the driving spindle of a printer.

According to a still other embodiment, the spools may have a gear wheel for co-operation with a corresponding gear in a thermal printer. Suchlike gear wheel can replace the knurled flanges such as 31 and 33.

Figure 3:
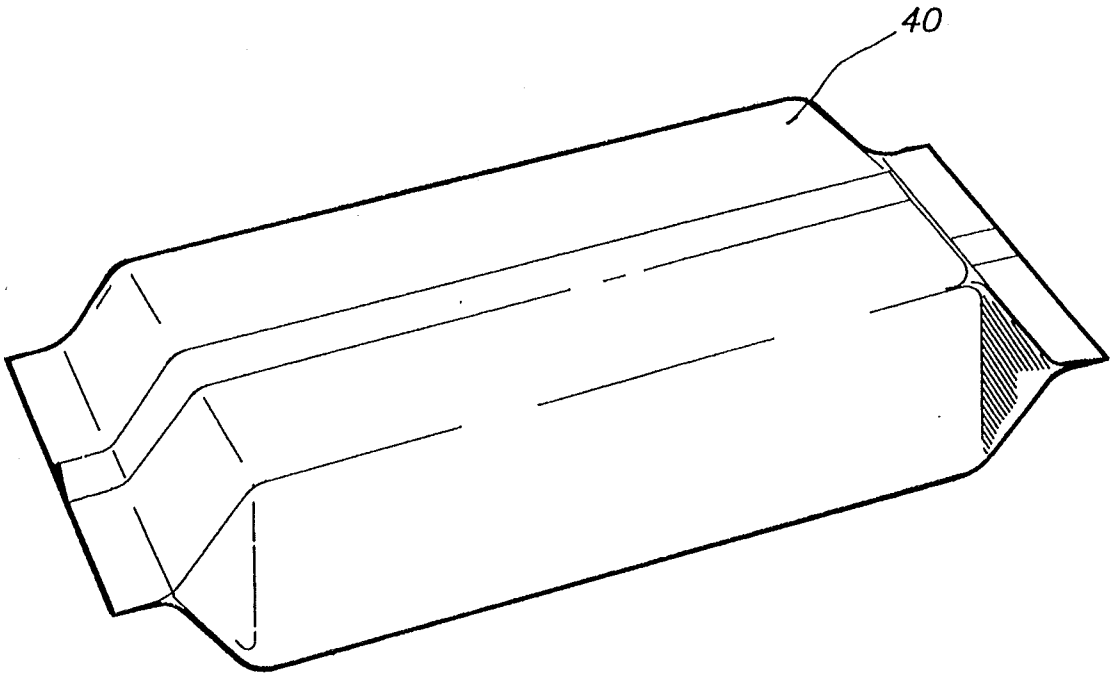
FIG. 3 shows a complete package.

The package described hereinbefore is closed by insertion of cover lip 29 in slot 30, and then air- and moisture-tightly sealed in a wrapper 40 as shown in FIG. 3. A suitable wrapping foil may be a laminate of a vacuum metallised polyester foil and a black-pigmented polyethylene foil, which allows heat sealing of the wrapping.

The loading of the spools from the package described hereinbefore into the cassette of a thermal printer can suitably occur as follows, with reference to FIG. 1.

The wrapping foil is removed from the package and the opened package is located in front of an empty cassette 41 on a desk or other flat surface . In its simplest form the cassette is a frame-like supporting structure which has slotlike openings in its lateral walls for receiving the core ends of the spools. The cassette shown in the figure is basically a traylike construction 42 with a large square opening in the bottom allowing a thermal printing head to urge the ribbon in contact with a receiver sheet under the cassette. The lateral walls of the cassette have slotlike openings 43, 44, 45 and 46 formed by resilient clips or the like, allowing insertion of the spool ends in the openings under a slight force and maintaining such ends in position during manipulations for placing the cassette in the printer.

The entry end of the clip means has an opening width smaller than the diameter of the core ends of the spools, whereas the central area of said clip means has a width larger than the diameter of said core ends thereby to allow appropriate centering of the spools by spindles of the printer entering in driving engagement with the spool ends after the cassette has been placed in the printer.

The spool which is nearest to the cassette, in the present case spool 12, is gripped by the operator with his fingertips at the front ends which are freely accessible at the outerside of the lateral walls 15 and 16 of the package, and then lifted and taken out, as indicated by the arrows 47 and 48 in order to locate it in the openings 43 and 45 of cassette 41.

Next, the spool of the package which is most remote from the cassette, i.e. spool 14, is taken out and loaded in the cassette along a path indicated by the arrows 50, 51 at the position which is most remote from the package, i.e. in the openings 44 and 46.

The loaded cassette can now be placed in a thermal printer, and after the spools have been drivingly engaged by driving pins of the apparatus, printing can start.

The foregoing description will have made it clear that a cassette which can be used in conjunction with the invention can widely depart from known cassettes that usually form an almost completely closed housing for the ribbon material.

Figure 4:
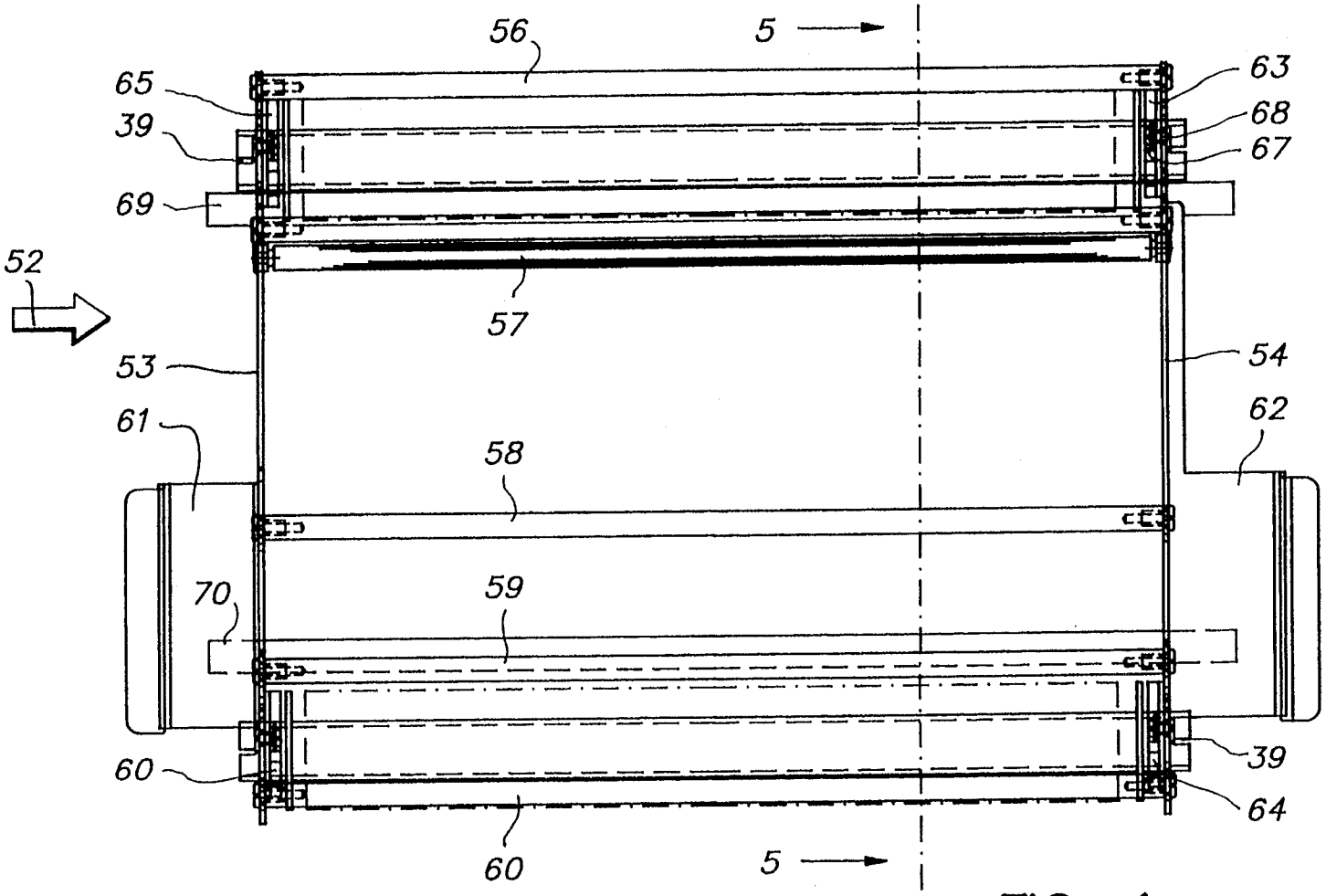
FIG. 4 is a top view of an embodiment of a cassette having generally the form of a frame.
Figure 5:
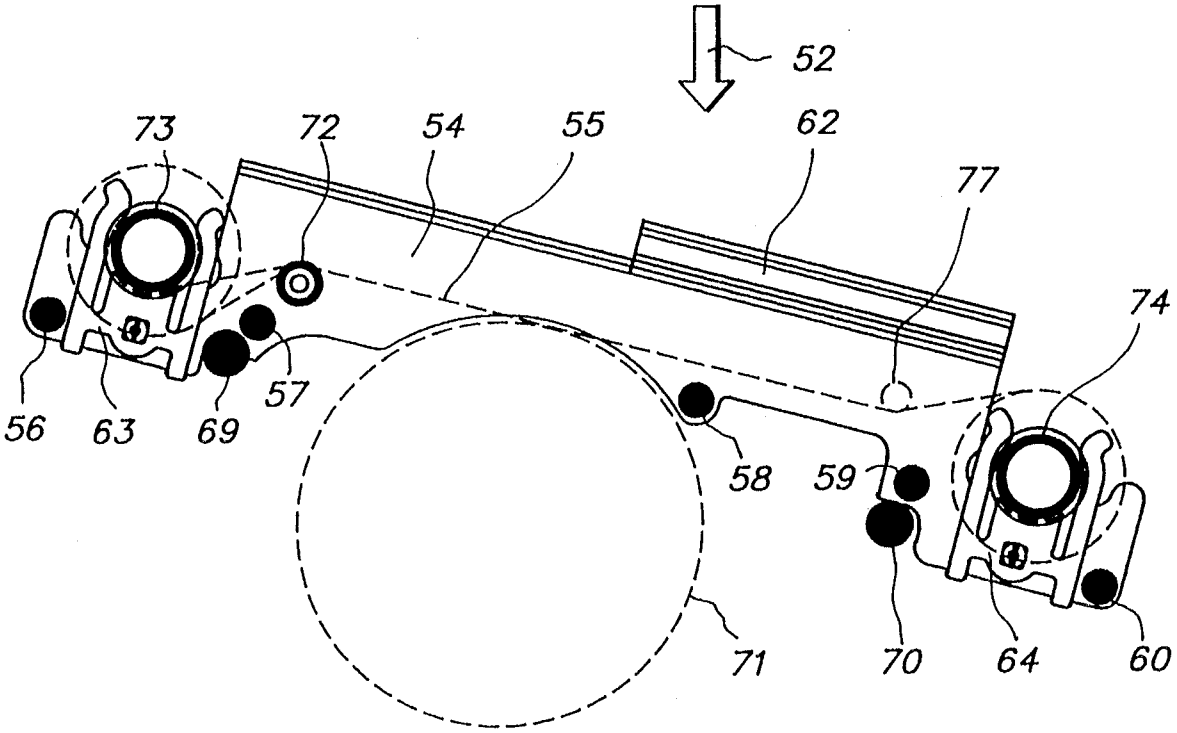
FIG. 5 is a cross-section on line 5—5 of FIG. 4.

A most stripped form of reloadable cassette which can be used in the method according to the invention is shown in FIGS. 4 and 5.

The cassette 52 consists basically of two flanges 53 and 54 spaced in parallel relationship by five rods 56 to 60. The flanges are made of sheet metal whereas the rods are solid and tapped at their ends to allow their fixing to the flanges by screws.

The flanges have outwardly angled portions 61 and 62 forming handles allowing easy gripping of the frame. The size of a full dye ribbon roll has been illustrated in dot-and-dash lines.

The supports for the spools are formed by four elastic clips 63 to 66 fitted to the flanges of the frame by a screw-and-nut connection, as shown by screw 67 and nut 68 for clip 63. The clips are suitably made of a resilient plastic and have rather long legs requiring but a limited force for the insertion of the spool ends in the clips. The spool ends are journalled with sufficient play in the curved portions of the legs of the clips to allow their precise radial centering by the driving spindles of the thermal printer, as known in the art.

The cassette 52 rests in the thermal printer on two supporting rods 69 and 70. The position of the drum of the printer which bears the receiving sheet is indicated in broken lines 71.

Finally, the cassette has an idler roller 72 for conveying the dye ribbon 55 unwound from supply spool 74 along the required path to the take-up spool 73. An idler roller 77 belongs to the lid of the thermal printer and in the closed position of the lid occupies a position as illustrated thereby to convey the ribbon closely past drum 71.

The invention is not limited to the described embodiments.

The construction of the ribbon package can be different from the illustrated one. For instance, the hinged cover can have side walls overlapping the side walls of the base thereby to close the outside of the slotlike openings in view of an improved protection of the spool ends during manipulation of the package.

Figure 6:
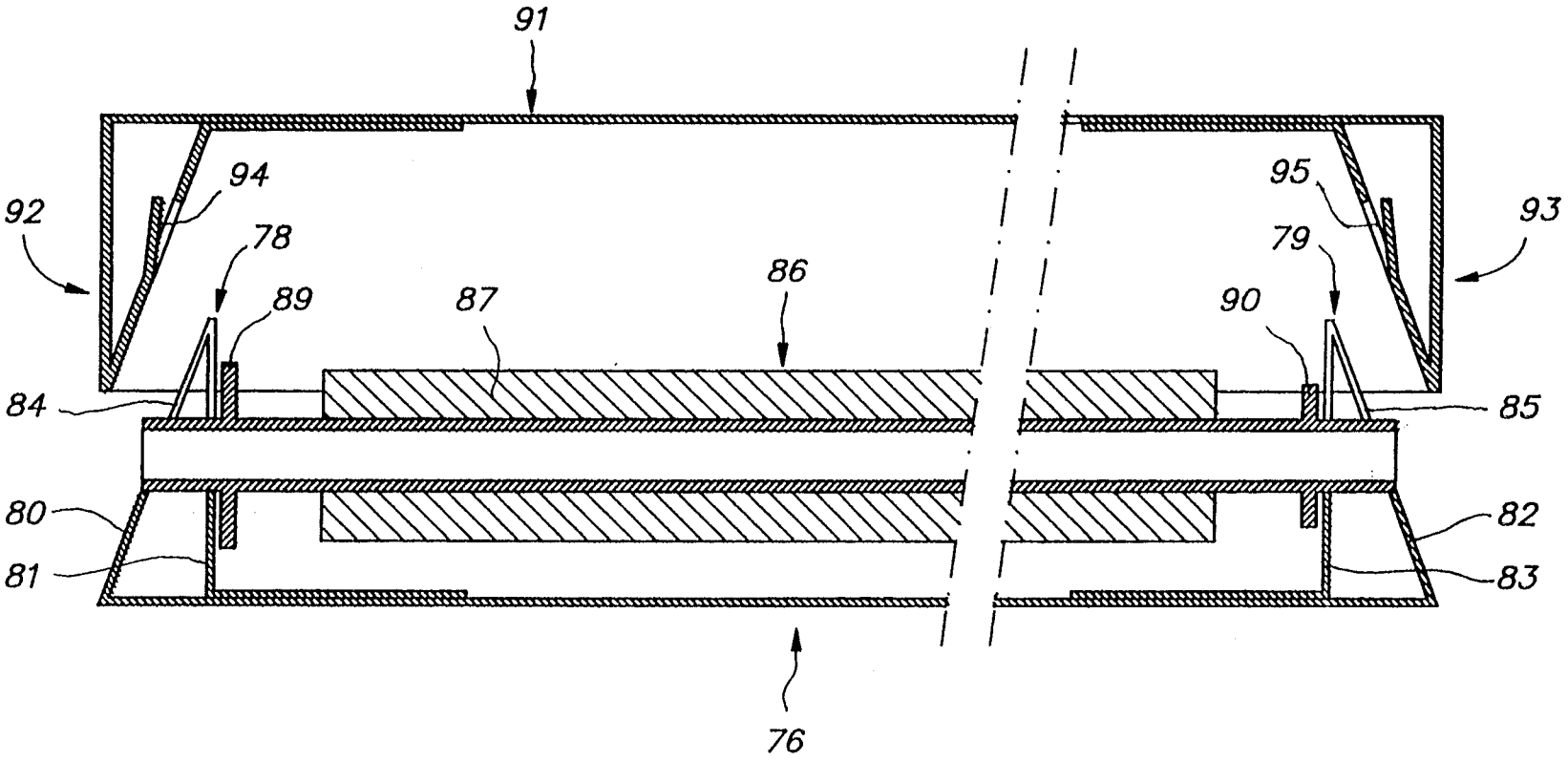
FIG. 6 is a longitudinal vertical section through the axis of the supply spool of another embodiment of a package according to the invention.

An example of a package with suchlike cover is shown in FIG. 6, wherein a base 76 is formed from a blank of corrugated board cut and folded to produce two lateral walls 78 and 79 each consisting of wall sections 80, 81 and 82,83 forming upstanding triangular configurations with cut-out slots 84 and 85 simalar to slots 25 to 28 of FIG.1. A spool 86 with a roll of ribbon 87 is journalled with its ends in the slots, and flanges 89 and 90 ensure the axial position of the spool by cooperating with the innerside wall sections 81 and 83. Hinging cover 91 has been shown in slightly lifted position for the sake of clarity, and has equally two lateral walls 92 and 93 with a triangular shape fitting closely over the corresponding walls of the base in the closed position of the cover. The innerside sections of walls 92 and 93 may have tongues such as 94 and 95 formed by appropriate cuts and are urged away by contact with the front ends of the spool as the cover is closed. The frictional engagement of the tongues with the core avoids clockspringing of the spool.

The package can be provided with other means, known on themselves, for preventing clockspringing unwinding of the supply spool during manipulations of the package. Suchlike means can co-operate with the flange(s) of the spool(s) or occasionally with gear-wheels making part of the spools.

The package can be formed from a sheet of corrugated polypropylene board instead of from paper board.

A loaded cassette can be stored in a suitable storage box in case if not in use in a printer. This may be the case e.g. when several cassettes are loaded at a time in order to have them instantly available for printing.

We claim:

1. A dye ribbon package for use with a thermal printer and containing a supply spool with a roll of the dye ribbon wound thereon with a leading end extending from such roll and a take-up spool having the leading end of the dye ribbon attached thereto for rewinding the ribbon as it is unwound from the supply spool, each such spool having a winding core and axially spaced apart flanges disposed on said core at points axially spaced from end faces of said core to define axially projecting free end portions on said core, said package comprising a generally rectangular bottom wall having a dimension between opposite sides thereof normal to said spool cores exceeding the length of said cores and two lateral wall means at said opposite sides of said bottom wall and integral therewith, each lateral wall means comprising two laterally spaced apart wall panels connected to said bottom wall in upstanding relation thereto, an outer one of said two panels being coterminous with said bottom wall side, the two panels of each wall means having slotlike openings extending downwardly from open ends in edges of said panels opposite to said bottom wall in alignment with each other and with the openings in the opposite wall means for reception of corresponding free end portions of the cores of the spools with said flanges proximate inside ones of said wall panels thereby to support both spools in parallel relationship, said slotlike openings allowing easy removal of the spools from the package in a direction radial to their axis, and end faces of said cores being readily accessible axially through said openings in the outer wall panels for gripping by an operator's fingers while the core end faces are situated inside of said outer wall panels and thereby protected.

2. A package according to claim 1 wherein said slotlike openings extend in a direction generally perpendicular to the bottom wall of the package.

3. A package according to claim 1, which has a hinged lid swingable from and to a closed position to and from an open position for closing in its closed position the open ends of said slotlike openings.

4. A package according to claim 3, wherein the hinged lid (17) has three sections that are hingedly connected with each other, one section being hingedly connected to said bottom wall.

5. A package according to claim 1, wherein each of said side wall means comprises two wall sections (21, 24) spaced in parallel.

6. A package according to claim 1, wherein at least one flange of a spool has a diameter at least equal to that of a roll of wound ribbon thereby to allow rotation of the spool by an operator while avoiding contact with the roll of ribbon.

7. A package according to claim 6, wherein said at least one spool flange has a knurled peripheral edge.

8. A package according to claim 1, which is made of corrugated board.

9. A dye ribbon package according to claim 8, wherein said board is paperboard or polypropylene board.

10. A dye ribbon package as in claim 1 wherein said wall panels of each lateral wall means at said opposite sides of said bottom wall are formed by an end flap integral with said bottom wall and folded up therefrom along a hinge line at said side thereof, an end portion of said flap being re-entrantly bent toward said bottom wall along a locus spaced from said hinge line to form said inner wall panel, said inner wall panel being anchored to said bottom wall to maintain said wall panels in said generally upstanding relation to said bottom wall.

11. A dye ribbon package as in claim 10 wherein said end portion of each said end flap is re-entrantly bent in inverted generally U-shaped cross-section parallel to the core axes to define wall panels upstanding from said bottom wall in generally parallel relation to one another.

12. A dye ribbon package as in claim 10 wherein said end flap is folded up from said bottom wall along said hinge line at an oblique angle inclined upwardly and inwardly of said hinge line, and said flap end portion is re-entrantly bent along said locus in a direction generally perpendicular to said bottom wall and anchored to said bottom wall.

13. A dye ribbon package as in claim 12 including a lid for said package, said lid being of inverted generally traylike configuration and including a top wall and side walls, said side walls including portions extending obliquely to said top wall at an angle generally corresponding to the oblique angle of the end portion of said end flap, the obliquely extending portions having a cutout therein to receive free end portions of said spool cores when the lid is in closed position.

14. The package of claim 1 wherein each of said lateral wall means comprised of said laterally spaced wall panels is hollow.

15. A method of loading with a supply spool having a roll of dye ribbon wound thereon and a take up spool having the leading end of the dye ribbon attached thereto a reloadable cassette of a thermal printer which is of generally flat traylike configuration open on its upper side and has a two spool positions therein arranged in spaced relation parallel to each other and the flat direction of the cassette, which comprises the steps of locating the reloadable cassette on a flat surface, locating on said surface in front of said cassette a dye ribbon package open on its upper side and having a supply spool wound with dye ribbon and a take up spool to which the leading end of the dye ribbon is attached supported removably therein in spaced generally parallel relation to said surface with the spools in said package generally parallel to the spool positions in said cassette, removing from the package the spool which is nearest to the cassette and loading said spool in the cassette at the spool position which is nearest to the dye ribbon package, and next removing from the package the spool which is remote from the cassette and loading said spool in the cassette at the spool position which is remote from the dye ribbon package.

16. A method of loading with a supply spool having a roll of dye ribbon wound thereon and a take up spool having the leading end of the dye ribbon attached thereto a reloadable cassette of a thermal printer which is of generally flat traylike configuration open on its upper side and has a two spool positions therein arranged in spaced relation parallel to each other and to the flat direction of the cassette, which comprises the steps of locating the reloadable cassette on a flat surface, locating on said surface in front of said cassette a dye ribbon package open on its upper side and having a supply spool wound with dye ribbon and a take up spool to which the leading end of the dye ribbon is attached supported removably therein in spaced generally parallel relation to said surface with the spools in said package generally parallel to the spool positions in said cassette, removing from the package the spool which is remote to the cassette and loading said spool in the cassette at the spool position which is remote to the dye ribbon package, and next removing from the package the spool which is nearest to the cassette and loading said spool in the cassette at the spool position which is nearest to the dye ribbon package.

* * * * *